US006203225B1

(12) United States Patent
Baudino et al.

(10) Patent No.: US 6,203,225 B1
(45) **Date of Patent: *Mar. 20, 2001**

(54) WRITING IMPLEMENT HAVING AN ERGONOMIC GRIP

(75) Inventors: Rodney J. Baudino, Woodridge; Brian F. Larson, Crystal Lake, both of IL (US)

(73) Assignee: Sanford, L. P., Bellwood, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/162,511

(22) Filed: Sep. 29, 1998

(51) Int. Cl.[7] ..... A46B 5/02
(52) U.S. Cl. ..... 401/6; 410/48
(58) Field of Search ..... D19/48; 401/6, 401/88, 221, 222

(56) References Cited

U.S. PATENT DOCUMENTS

| | | | |
|---|---|---|---|
| D. 35,610 | | 1/1902 | Vernon . |
| 141,287 | | 7/1873 | Orndorff . |
| D. 155,429 | | 6/1949 | Kahn . |
| D. 186,149 | | 9/1959 | Schler . |
| D. 187,255 | | 2/1960 | Sams et al. . |
| D. 190,263 | * | 5/1961 | Kaplan ..... 401/6 |
| D. 191,341 | | 9/1961 | Fuchs . |
| D. 240,817 | | 8/1976 | Funahashi . |
| D. 248,028 | | 5/1978 | Huffman . |
| D. 256,925 | | 9/1980 | Postrehovsky-Axel . |
| D. 292,104 | | 9/1987 | Keller, Jr. . |
| D. 298,551 | | 11/1988 | Bright . |
| D. 307,444 | | 4/1990 | Poisson et al. . |
| D. 311,421 | | 10/1990 | Mardock . |
| D. 314,978 | | 2/1991 | Oka . |
| D. 319,662 | | 9/1991 | Henry . |
| D. 325,932 | | 5/1992 | Redfern . |
| D. 331,778 | | 12/1992 | Christen . |
| D. 334,023 | | 3/1993 | Giugiaro . |
| D. 335,140 | | 4/1993 | Walker . |
| D. 338,915 | | 8/1993 | Willat . |
| D. 358,170 | | 5/1995 | Osada . |
| D. 359,758 | | 6/1995 | Inami . |
| D. 373,143 | | 8/1996 | Jagger . |
| D. 378,601 | | 3/1997 | Sakuno . |
| D. 380,046 | | 6/1997 | Domanowski . |

(List continued on next page.)

FOREIGN PATENT DOCUMENTS

| | | |
|---|---|---|
| PCT/AU87/00183 | 1/1988 | (AT) . |
| 5 466 32 | 3/1932 | (DE) . |
| 2 157 175 | 5/1973 | (DE) . |
| 2 840 429 | 9/1978 | (DE) . |
| 3 406 522 A1 | 7/1984 | (DE) . |
| 3922 | 5/1903 | (GB) . |
| 6-48086 | 2/1994 | (JP) . |

OTHER PUBLICATIONS

Pencils, Mechanical, Logsdon Office Supply Catalog, (1998), p. 808.
Pens/Retractable Ballpoint, OfficeMax catalog (1997), p. 808.
Soft–tip & Security Pens, Quill Corp. catalog (1998), p. 91.

*Primary Examiner*—David J. Walczak
(74) *Attorney, Agent, or Firm*—Foley & Lardner

(57) ABSTRACT

A writing implement comprising: a barrel; a compressible grip disposed over the barrel having an outer surface that includes at least two recessed portions, each recessed portion creating a concave depression running at least some portion of the length of the grip, each recessed portion having a plurality of ribs; and an air gap provided between the barrel and the grip.

10 Claims, 5 Drawing Sheets

U.S. PATENT DOCUMENTS

| | | | |
|---|---|---|---|
| D. 394,455 | | 5/1998 | Izushima . |
| 544,990 | | 8/1895 | Miller . |
| 624,853 | | 5/1899 | Oberbeck . |
| 770,363 | | 9/1904 | Goldsmith . |
| 782,388 | | 2/1905 | Goldsmith . |
| 839,537 | | 12/1906 | Beaumel . |
| 1,291,972 | | 1/1919 | McGuigan . |
| 1,598,873 | | 9/1926 | Peterson . |
| 1,807,415 | | 5/1931 | LaFrance . |
| 1,868,441 | | 7/1932 | Colfelt . |
| 2,173,451 | | 9/1939 | Lorber . |
| 2,180,560 | | 11/1939 | Stempel . |
| 2,236,194 | | 3/1941 | Lorber . |
| 2,594,955 | | 4/1952 | Markowitz . |
| 2,759,453 | | 8/1956 | De Baun . |
| 2,845,047 | | 9/1958 | McKendree . |
| 3,269,399 | | 8/1966 | Smith . |
| 4,035,089 | | 7/1977 | Schwartz et al. . |
| 4,056,325 | | 11/1977 | Maruyama . |
| 4,076,427 | | 2/1978 | Anderson . |
| 4,167,347 | | 9/1979 | Hoyle . |
| 4,526,547 | * | 7/1985 | Rusk ..... 401/6 |
| 4,601,598 | | 7/1986 | Schwartz et al. . |
| 4,617,697 | | 10/1986 | David . |
| 4,689,020 | | 8/1987 | Rusk . |
| 4,832,604 | | 5/1989 | Rusk . |
| 4,932,800 | | 6/1990 | Lin et al. . |
| 4,934,024 | | 6/1990 | Sexton, I . |
| 4,944,766 | | 7/1990 | Williams . |
| 5,000,599 | | 3/1991 | McCall et al. . |
| 5,056,945 | | 10/1991 | Klodt . |
| 5,143,463 | | 9/1992 | Pozil et al. . |
| 5,146,810 | | 9/1992 | Mueller . |
| 5,180,239 | | 1/1993 | Bistrack . |
| 5,320,438 | | 6/1994 | Yang . |
| 5,332,324 | | 7/1994 | Hochstetler . |
| 5,354,140 | | 10/1994 | Diakoulas . |
| 5,468,083 | | 11/1995 | Chesar . |
| 5,470,162 | | 11/1995 | Rubin . |
| 5,475,896 | | 12/1995 | Gain . |
| 5,549,405 | | 8/1996 | Krahn . |
| 5,555,602 | | 9/1996 | Leamond . |
| 5,558,452 | | 9/1996 | Oka et al. . |
| 5,626,430 | | 5/1997 | Bistrack . |
| 5,662,423 | | 9/1997 | Walden . |
| 5,707,165 | | 1/1998 | Albright . |
| 5,722,575 | | 3/1998 | Smith . |
| 5,735,622 | | 4/1998 | Melnick et al. . |

* cited by examiner

WRITING IMPLEMENT HAVING AN ERGONOMIC GRIP

The present application claims priority under 35 U.S.C. § 120 to U.S. Ser. No. 29/071,257 filed Jul. 3, 1997, the text of which is incorporated herein by reference in its entirety.

BACKGROUND OF THE INVENTION

1. The Field of the Invention

This invention relates to a writing implement with an improved grip that is ergonomic and provides comfort to the user.

2. Description of Related Art

A wide variety of patents dealing with writing implements and user comfort have been issued. Most have to do with accessories that are attached to writing implements and that function essentially as grip enhancers. Examples of such devices are disclosed in U.S. Pat. Nos. 5,143,463; 5,468,083; 5,558,452; and 4,932,800. They are basically directed toward improving the user's grasp of the writing implement, thus also increasing the user's comfort. Some, such as U.S. Pat. No. 4,617,697, are intended to mold the accessory to the user's hand. This feature (of conforming to the user's hand) has also been patented as an integral part of the writing implement itself (rather than as an external accessory). An example of such a device is disclosed in U.S. Pat. No. 5,000,599.

While various types of grip enhancers and grip-enhanced writing implements are known in the art, there remains a need for a writing implement that is more ergonomic. Furthermore, this goal is best accomplished with features that are a part ot the writing implement, i.e. it is more efficient to provide to the user a writing implement that contains everything that one needs (versus an accessory to attach to an implement). In addition, while there are patents that mold to the user's hand, there remains a need for a writing implement that immediately fits the hand of a variety of users and gives each immediate comfort and ease of use.

The present invention, inter alia, is directed toward overcoming the abovementioned shortcomings and meeting the above-mentioned goals.

SUMMARY OF THE INVENTION

The present invention features a better writing implement with an improved grip that provides a cushioning effect and preferably includes an elastomer formed in a round-to triangular-to round configuration. A grip according to the present invention includes an air gap so that it is more ergonomic and comfortable to the user.

This invention in one embodiment includes a writing implement comprising a barrel and a compressible grip disposed over the barrel. The grip can be of any shape, and preferably is an hourglass shape and has an outer surface that includes at least two, and preferably three recessed portions. Each recessed portion creates a concave depression that runs along a major portion of the length of the grip, and each recessed portion has a plurality of ribs. The cross-section of the grip generally is round at both ends, and triangular in at least some portion such that the cross-section of the grip runs from round to triangular to round about the length of the grip.

In accordance with another embodiment of the invention, the writing implement also has an air gap formed between the inner diameter of the grip and the outer diameter of the barrel. This results in a cushioning effect such that it provides comfort to a user as he/she is writing with the implement.

According to another embodiment of the present invention, there is provided a grip that has a compressible sleeve. This sleeve has at least two recessed portions, and each recessed portion creates a concave depression that runs along a major portion of the grip. Each recessed portion also has a plurality of ribs.

Further objects, features and advantages of the invention will become apparent hence the detailed description that follows.

DETAILED DESCRIPTION OF A PREFERRED EMBODIMENT

A preferred embodiment of this invention will be described with reference to the accompanying drawings. It is understood that this preferred embodiment is just one example of the invention.

Figure 1:
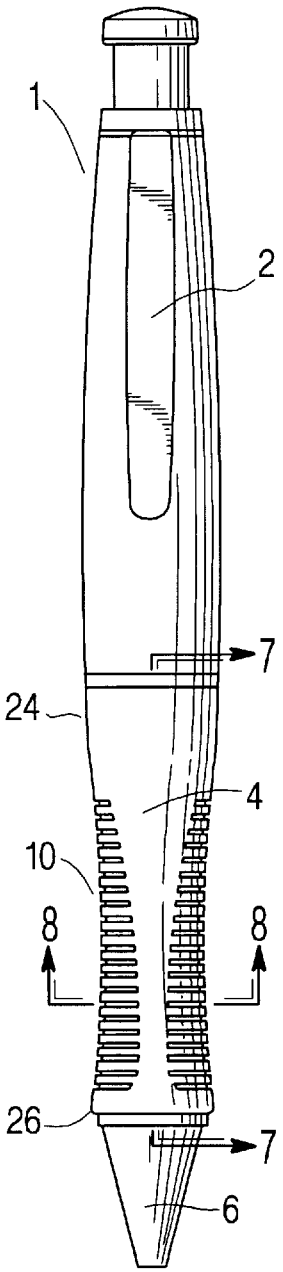
FIG. 1 is a front elevational view of a writing implement showing an embodiment of the present invention.
Figure 2:
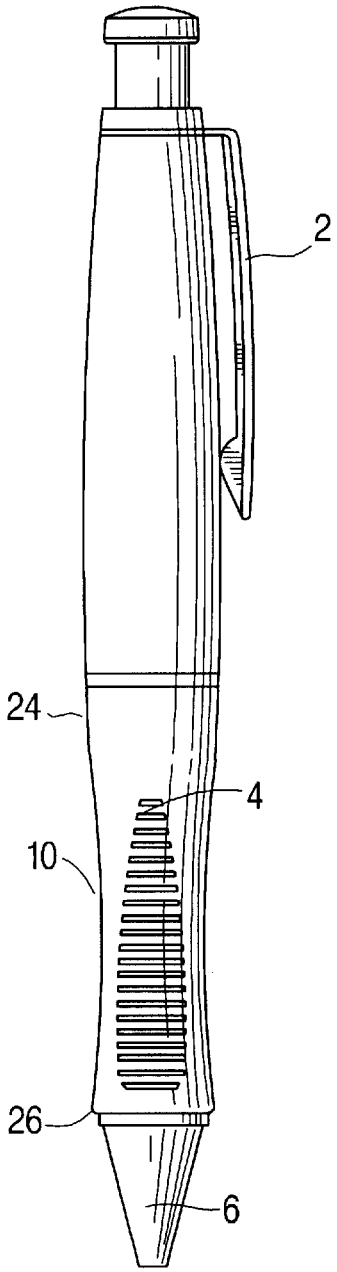
FIG. 2 is a front elevational view of a writing implement according to FIG. 1 which has been rotated 90°.
Figure 3:
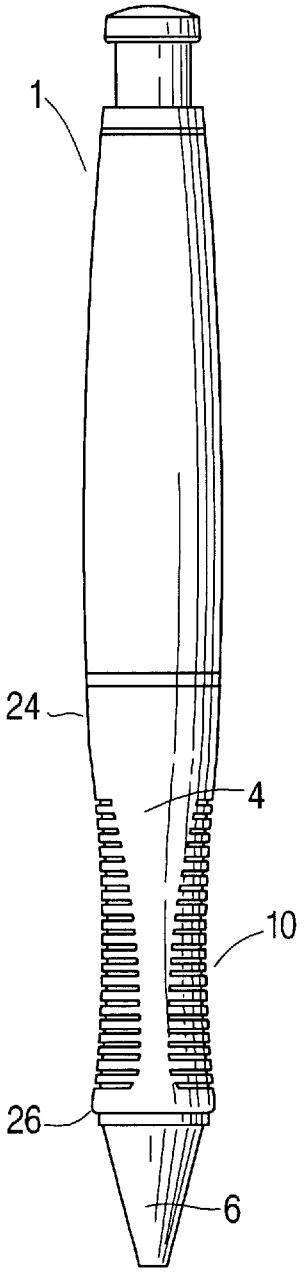
FIG. 3 is a front elevational view of a writing implement according to FIG. 1 which has been rotated 180°.
Figure 4:
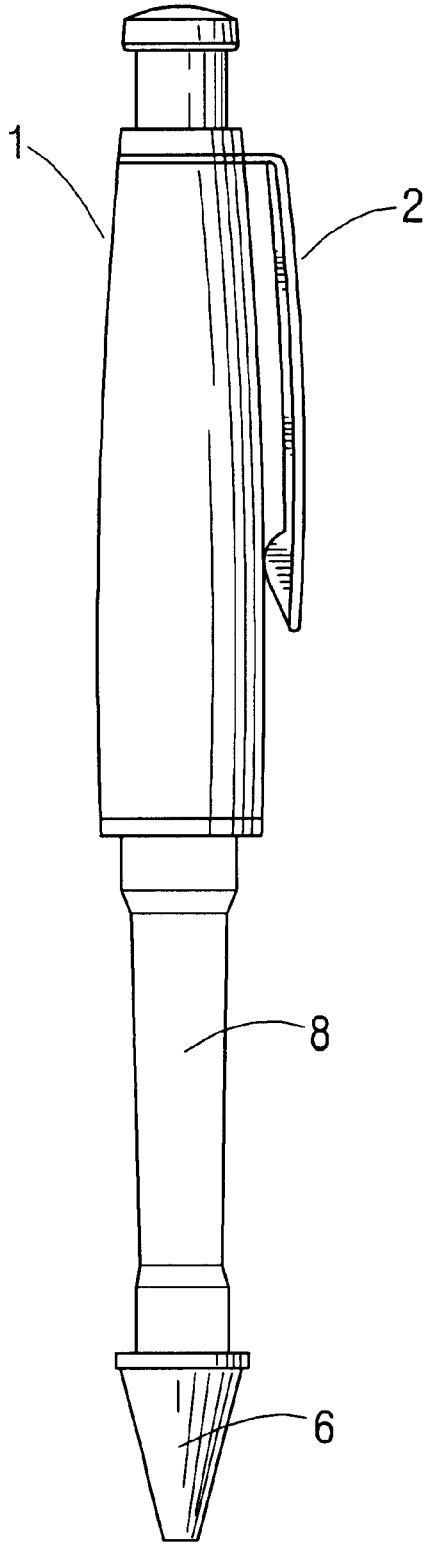
FIG. 4 is a front elevational view of a writing implement according to FIG. 2 which is shown without the grip.

FIG. 1 shows a preferred embodiment of the present invention in a front elevational view. A writing implement 1 consists of a clip 2, a compressible grip 4, and a tip 6. FIGS. 2 and 3 show FIG. 1 rotated 90° and 180°, respectively. FIG. 4 shows a writing implement minus the compressible grip 4 in order to illustrate the barrel 8 portion of the writing implement 1. The compressible grip 4 is assembled over the barrel 8, such as by unscrewing the tip from the barrel 8 and sliding the grip 4 over the barrel 8. The normal internal component of the implement 1, such as a ball-point or roller ball pen or mechanical pencil components, are not illustrated as they, in and of themselves, do not form part of the present invention.

Figure 5:
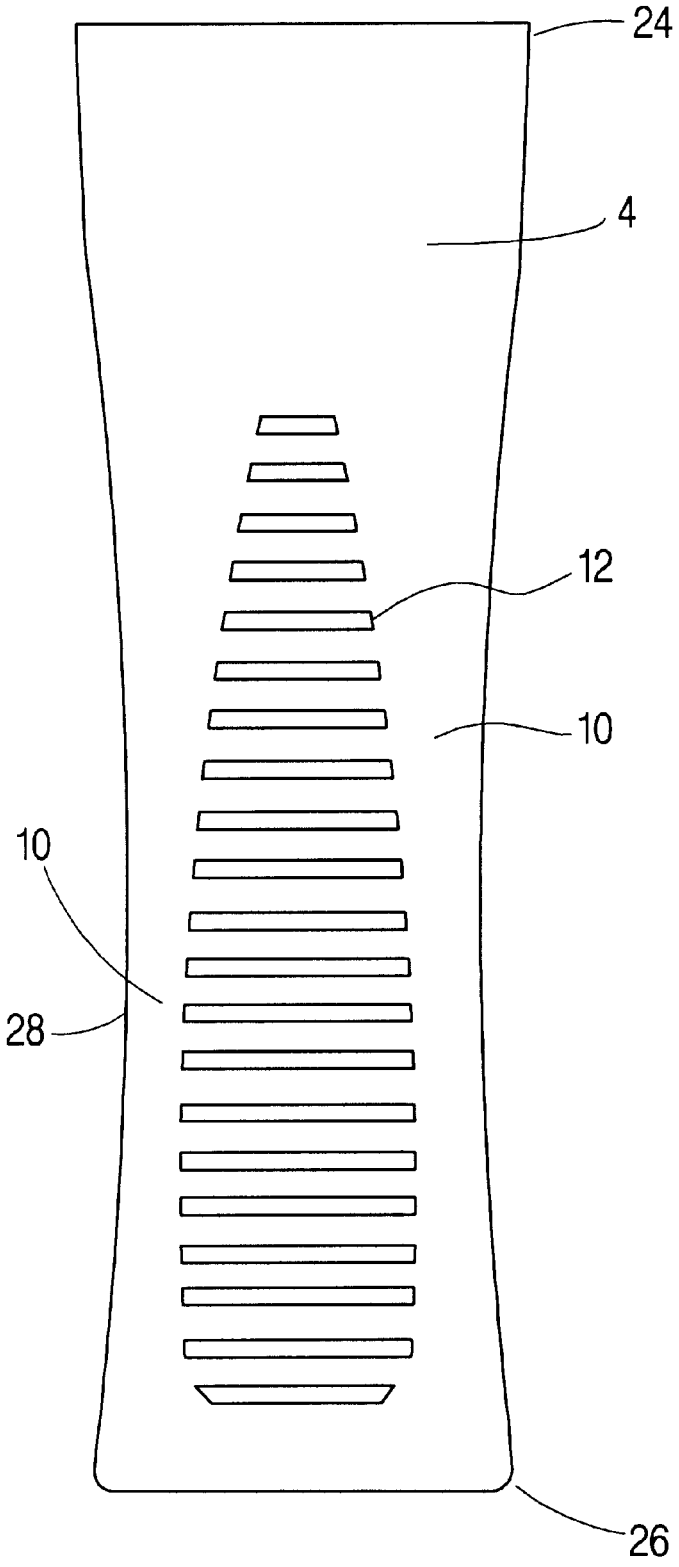
FIG. 5 is a plan view of a grip showing an embodiment of the present invention.

FIG. 5 is a plan view of the compressible grip 4. The grip 4 preferably is in the general shape of an hourglass and consists of a plurality of recessed portions 10. In particular, it is preferable that the grip have a cross section at each end 24, 26 that is round, and at least some portion in the mid section of the grip 28 that is flattened, or preferably triangular in cross-section. The flattened or triangular section can be up to 90% of the length of the grip, and in preferred embodiments is from 20–80% of the entire length, more preferably 25–75%, and advantageously 30–70% of the length has a triangular cross section. It is particularly preferable that at least 10% of the total length of the grip have at least a somewhat flattened or triangular cross section.

The recessed portions 10 run a substantial part of the length of the grip 4, i.e. up to 90%, and preferably from 20–80% of the length, creating concave depressions that produce a shape that is depressed in the central portion, for example, an hourglass-type shape. The depressed sections can be substantially planar, or can be curved to a small extent, so as to form an arc. Three recessed portions 10, as shown in FIGS. 1–3, are preferably included, inter alia, because the use of exactly three recessed portions fit the shape of a human hand well when it grasps the grip 4 of the writing implement 1 (the thumb, forefinger, and middle finger are utilized in gripping a writing implement—each of the three recessed portions supports one of those three fingers).

The compressible grip 4 is preferably made of an elastomeric material, such as rubber or a synthetic rubber-compound such as a polyurethane, silicone rubber, and other plastics, resins or the like. Thermoplastic elastomers having a specific gravity between 0.5 and 1.0, more preferably between 0.75 and 0.90, and advantageously between 0.85 and 0.90 in some instances, a hardness between 5 and 75, advantageously between 15 and 50, a tensile modulus between 50 and 500 psi, advantageously between 100 and 400 psi and a tensile strength between 100 and 2000 psi, advantageously between 400 and 1250 psi are particularly suitable. The inner diameter (ID) of the grip 4 at the outermost tip end 26 is preferably cylindrical and smooth, with a gradually increasing diameter. Thus, the ID increases from the tip end 26 to the opposite end 24. The ID at the tip end 26 preferably is within 0.2–0.5 inches, more preferably from 0.3 and 0.4 inches, particularly preferably from 0.345 and 0.355 inches, and the OD is preferably within 0.25–0.6 inches, more preferably from 0.45–0.55 inches, particularly preferably 0.487–0.537 inches with a resultant thickness ranging approximately from 0.05–0.40 inches, advantageously from 0.1–0.2 inches, particularly preferably from 0.132–0.192 inches. The ID at the opposite end 24 preferably is within 0.2–0.7 inches, preferably from 0.4–0.5 inches, advantageously from 0.42–0.43 inches, and the OD is preferably within 0.25–0.8 inches, preferably between 0.5 and 0.6, advantageously from 0.562–0.572 inches, with a resultant thickness ranging approximately from 0.05–0.6 inches, preferably from 0.1 and 0.2 inches, advantageously from 0.132–0.152 inches.

Each recessed portion 10 has a plurality of ribs 12. The ribs 12 extend parallel to one another and in a plane perpendicular to the implement's longitudinal axis. From the tip end 26, the ribs 12 preferably increase in length and then gradually taper to a smaller length at an outermost portion of the recess 10 at a point approximately three-fourths of the length of the compressible grip 4 away from the tip end 26. Placing the ribs 12 on the grip 4 such that they occupy the area most in contact with a user's hand results in a better grasp of the implement for the user.

Figure 6:
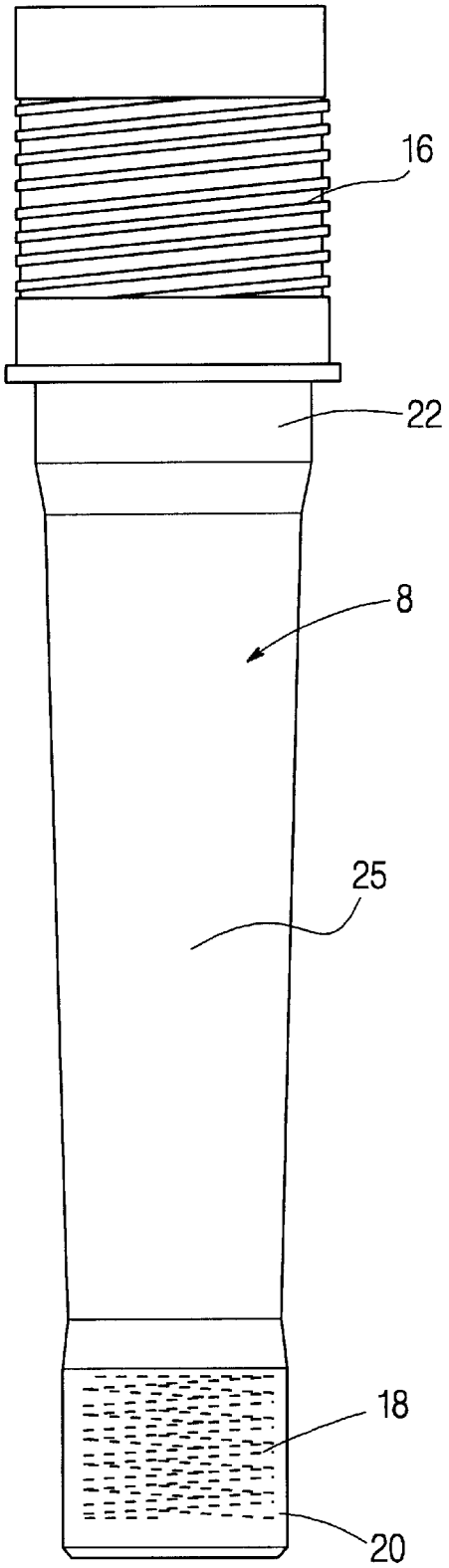
FIG. 6 is a plan view of a barrel showing an embodiment of the present invention.

The barrel 8 of the writing implement is shown in greater detail in the plan view of FIG. 6. As can be seen, the barrel tapers toward the tip 6 end of the writing implement 1. At this end, there preferably are internal threads 18 in the barrel 8 to secure the barrel 8 to the tip 6. The barrel 8 preferably also has external threads 16 on its opposite end to secure the barrel 8 to the upper portion of the writing implement (portion A in FIG. 1). These external threads are visible in FIG. 6, but not in FIG. 4 because portion A is assembled over those threads when the barrel 8 is attached. The barrel is preferably made of a resinous material, such as polypropylene or other plastic.

Figure 7:
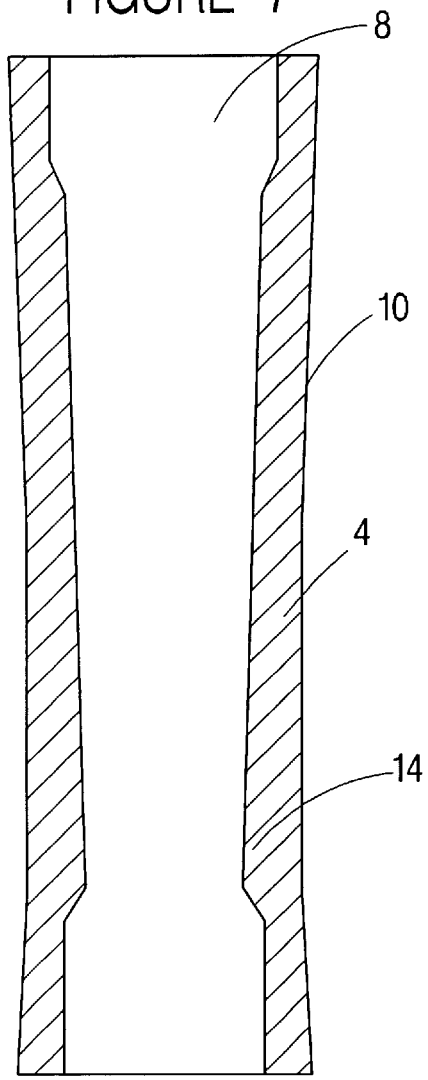
FIG. 7 is a cross-sectional view of the portion B of FIG. 1 taken along the lines 7—7.
Figure 8:
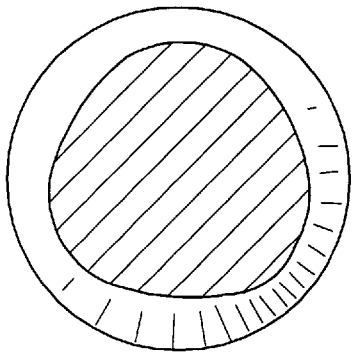
FIG. 8 is a cross-sectional view of FIG. 1, taken along the lines 8—8.

A cross-sectional view of the compressible grip 4 assembled over the barrel 8 is shown in FIG. 7, which is a view taken along the lines 7—7 in FIG. 1. An air gap 14 is formed at least at some portion about the length of the grip between the OD of the barrel 12 and the ID of the compressible grip 4. The width of the air gap 14 varies according to longitudinal position along the barrel, with the wide gap preferably in the area where the writing implement 1 is to be held by the user and the narrow gap at the ends of the grip (note that the grip 4 should generally snuggly encase the barrel 8 at both ends 20 and 22 (each being circular in cross section and preferably having a diameter greater than the connecting tube 25 between them), to provide an interference fit between these two components, thereby facilitating assembly. Tube 25 has a gradual decreasing diameter from a larger diameter near barrel end 22 to a smaller diameter adjacent barrel end 20. In general, the greater the gap, the greater the cushioning effect, and thus greater comfort to the user. The gap preferably ranges from approximately 0.005 to 0.015 inches, advantageously from 0.005 to 0.015, and expediently from 0.006 to 0.012 in some instances.

Although only a few exemplary embodiments of this invention have been described in detail above, those skilled in the art will readily appreciate that many modifications are possible in the exemplary embodiments without materially departing from the teachings and advantages of this invention. Accordingly, all such modifications are intended to be included within the scope of this invention.

What is claimed is:

1. A grip for a writing implement comprising:

an elongate compressible sleeve made from an elastomeric material selected from the group consisting of natural rubber, synthetic rubber, polyurethanes, and silicone rubbers, the sleeve having a longitudinal axis, first and second ends and at least two recessed portions, each recessed portion creating a concave depression running at least 10% of the length of the grip between the first and second ends, each recessed portion having a plurality of ribs formed by parallel slots, the tops of the ribs forming the concave depression, the sleeve having transverse cross-sections that are round at and near both the first and second ends of said sleeve and that include both round and flattened portions when the transverse cross-sections are taken through a part of the sleeve which includes the recessed portions and wherein a transverse cross-section taken through the recessed portions includes alternating round portions having a first radius of curvature and flattened portions which have a radius curvature exceeding the first radius of curvature.

2. The grip of claim 1 wherein there are three recessed portions.

3. The grip of claim 1 wherein the recessed portion extends for between 30%–70% of the length of the grip.

4. The grip of claim 1 wherein the ribs extend in a direction which is generally perpendicular to the longitudinal axis of the sleeve.

5. The grip of claim 1 wherein the overall shape of the sleeve is an hourglass shape and the area of a transverse cross-section of the sleeve is smallest at a location nearer one end than the other end.

6. A writing implement having a writing end and a generally cylindrical grip, the grip being located at the area of the implement which would be grasped by a user and having a diameter which is equal to or less than the largest diameter of the remainder of the writing implement, the grip including a longitudinal opening for receiving the implement and comprising an elongate, compressible sleeve made from an elastomeric material selected from the group consisting of natural rubber, synthetic rubber, polyurethanes, and silicone rubbers, the sleeve having a first end located near the writing end and a second end more remote from the writing end and at least two recessed portions, each recessed portion creating a concave depression running at least 10% of the length of the grip and between the first and second ends, each recessed portion having a plurality of ribs formed by a plurality of parallel slots, the top of the ribs forming the concave depression, said sleeve having transverse cross-sections that are round at and near both the first and second ends of said sleeve and that include both round and flattened portions which the cross-sections are taken through a part of the sleeve which includes the recessed portions and wherein a transverse cross-section taken through the recessed portions includes alternating round portions having a first radius of curvature and flattened portions which have a radius curvature exceeding the first radius of curvature.

7. The implement of claim 6 wherein there are three recessed portions.

8. The implement of claim 6 wherein the recessed portion extends for between 30%–70% of the length of the grip.

9. The implement of claim 6 wherein the ribs extend in a direction which is generally perpendicular to the longitudinal axis of the sleeve.

10. The implement of claim 6 wherein the overall shape of the sleeve is an hourglass shape and the area of a transverse cross-section of the sleeve is smallest at a location nearer the writing end than the other end.

* * * * *